United States Patent [19]

Ono et al.

[11] 4,358,840

[45] Nov. 9, 1982

[54] ANALOGUE ALARM ELECTRONIC TIMEPIECE

[75] Inventors: Kenichi Ono; Shuji Otawa; Masaharu Shida, all of Tokyo, Japan

[73] Assignee: Kabushiki Kaisha Daini Seikosha, Japan

[21] Appl. No.: 124,255

[22] Filed: Feb. 25, 1980

[30] Foreign Application Priority Data

Feb. 26, 1979 [JP] Japan ..... 54-21642

[51] Int. Cl.[3] ..... G04C 21/16; G04C 23/14

[52] U.S. Cl. ..... 368/251; 368/74

[58] Field of Search ..... 368/72, 73, 76, 80, 368/250, 251

[56] References Cited

U.S. PATENT DOCUMENTS

| | | | |
|---|---|---|---|
| 3,775,967 | 12/1973 | Spadini | 368/73 |
| 4,040,248 | 8/1977 | Laesser | 368/252 |
| 4,196,583 | 4/1980 | Komaki | 368/80 X |
| 4,205,519 | 6/1980 | Deruns | 368/73 |
| 4,223,523 | 9/1980 | Kamijo | 368/72 X |
| 4,253,172 | 2/1981 | Nomura | 368/76 X |

*Primary Examiner*—Bernard Roskoski

*Attorney, Agent, or Firm*—Robert E. Burns; Emmanuel J. Lobato; Bruce L. Adams

[57] ABSTRACT

An analogue alarm electronic timepiece has electronic circuitry for controlling the drive of the time-indicating hands by a reversible stepping motor to selectively position the hands at desired alarm time and display time settings. Externally operable switches control the operation of the electronic circuitry and enable re-positioning of the hands by the motor to the previously set alarm time so that the user of the timepiece may confirm the alarm time setting. The electronic circuit includes a first settable memory means for storing the time difference between the alarm time and the present time, and a second settable memory means for storing the time difference between the present time and the display time. First means are provided for detecting coincidences between the alarm time and the present time. Second means are provided for detecting coincidence between the present time and the display time.

3 Claims, 23 Drawing Figures

ANALOGUE ALARM ELECTRONIC TIMEPIECE

BACKGROUND OF THE INVENTION

The present invention relates to an analogue alarm electronic timepiece which is simple in arrangement.

In this specification, although a quartz oscillator type of analogue alarm electronic timepiece will be described as a specific example, the present invention is applicable to a timpiece having another type of time standard system or a table clock.

FIG. 1 illustrates one example of a block diagram of the conventional analogue alarm electronic timepiece. An oscillating circuit 1 produces a high frequency signal as a time standard signal. A frequency dividing circuit 2 divides down the high frequency signal and produces a signal which is necessary for operating the following circuits. A driving circuit 3 synthesizes an output signal from the frequency dividing circuit 2 and periodically generates driving pluses with proper pulse width. A motor 4 converts the driving pulses into a mechanical motion. A gear train 5 and a hand (display mechanism 6) are used for transmitting the mechanical output from the motor 4 and displaying the time, respectively. An alarm time setting mechanism 8 is a provided for setting and displaying an alarm time, and the setting and displaying operation is carried out by moving an alarm setting wheel or a sub-hand which is operated by operator. A coincidence detecting mechanism 7 is a switch mechanism operated in relation to the gear train 5 and the alarm time setting mechanism 8. The fact that the present time is coincident with an alarm time, is detected in accordance with the ON-OFF condition of the switch mechanism, and an electric signal is produced. An alarm circuit 9 synthesizes an alarm driving signal on the basis of the output signal from the frequency dividing circuit 2, and the circuit 9 outputs the alarm driving signal when the coincidence detecting mechanism 7 detects the fact that the present time is coincident with the alarm time. An alarm device 10 is a piezoelectric element or an electromagnetic type of electricacoustic transducer which converts the alarm driving signal into a sound and the sound is made.

The above mentioned analogue alarm electronic timepiece is disadvantageous in that since the mechanical construction of the alarm time setting mechanism 8 and the coincidence detecting mechanism 7 are complex, it is difficult to obtain a small size timepiece or a thin-type timepiece, and the cost of manufacture is high. Moreover, since a special display device is required for setting and indicating the alarm time, it is not possible to freely decide the outer-look design for a timepiece. Furthermore, in such an analogue alarm electronic timepiece, since the coincidence detecting mechanism 7 is a mechanical switch, it is difficult to exactly set an alarm time in the unit of minute or second.

SUMMARY OF THE INVENTION

It is, therefore, an object of the present invention to provide an analogue alarm electronic timepiece, wherein the above described drawbacks in the conventional analogue alarm electronic timepiece are eliminated and an easy operation can be obtained.

It is another object of the present invention to provide an analogue alarm electronic timepiece which detects electrically whether or not an alarm time is coincident with the present time without the use of mechanical means.

It is another object of the present invention to provide an analogue alarm electronic timepiece, wherein as time hands for normally indicating the time are used for setting and displaying the alarm time, it is possible to exactly set the alarm time in the unit of minute or second and to freely decide the design for the outer-view of the timepiece.

It is a further object of the present invention to provide an analogue alarm electronic timepiece, wherein any special mechanisms for the location of hands, detecting the location or the like, are not required for realizing these functions.

It is a still further object of the present invention to provide an analogue alarm electronic timepiece, wherein the hand indication state can be recognized by automatically making the various sounds in accordance with the hand indication state to reduce the wrong manipulations.

DETAILED DESCRIPTION

Figure 1:
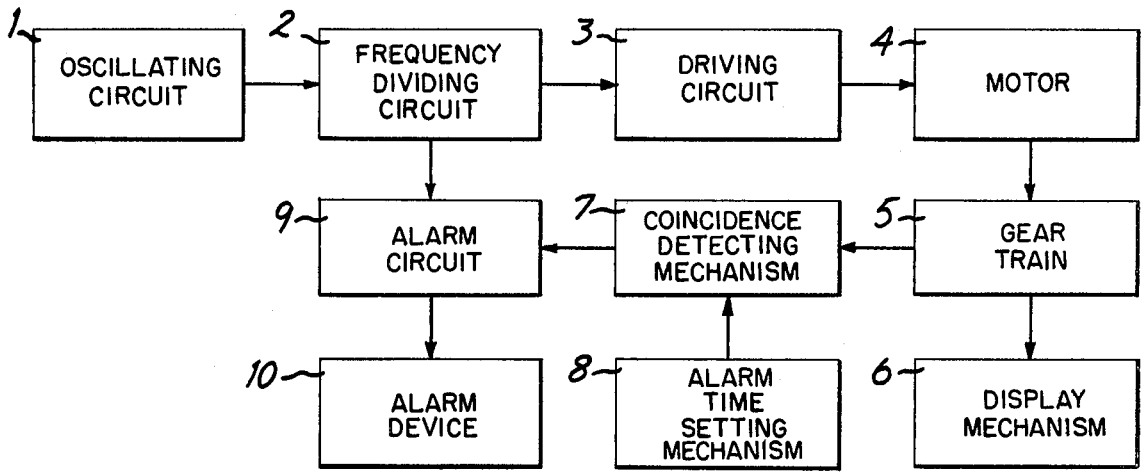
FIG. 1 (PRIOR ART)
FIG. 1 is a block diagram of a conventional analogue alarm electronic timepiece.
Figure 2:
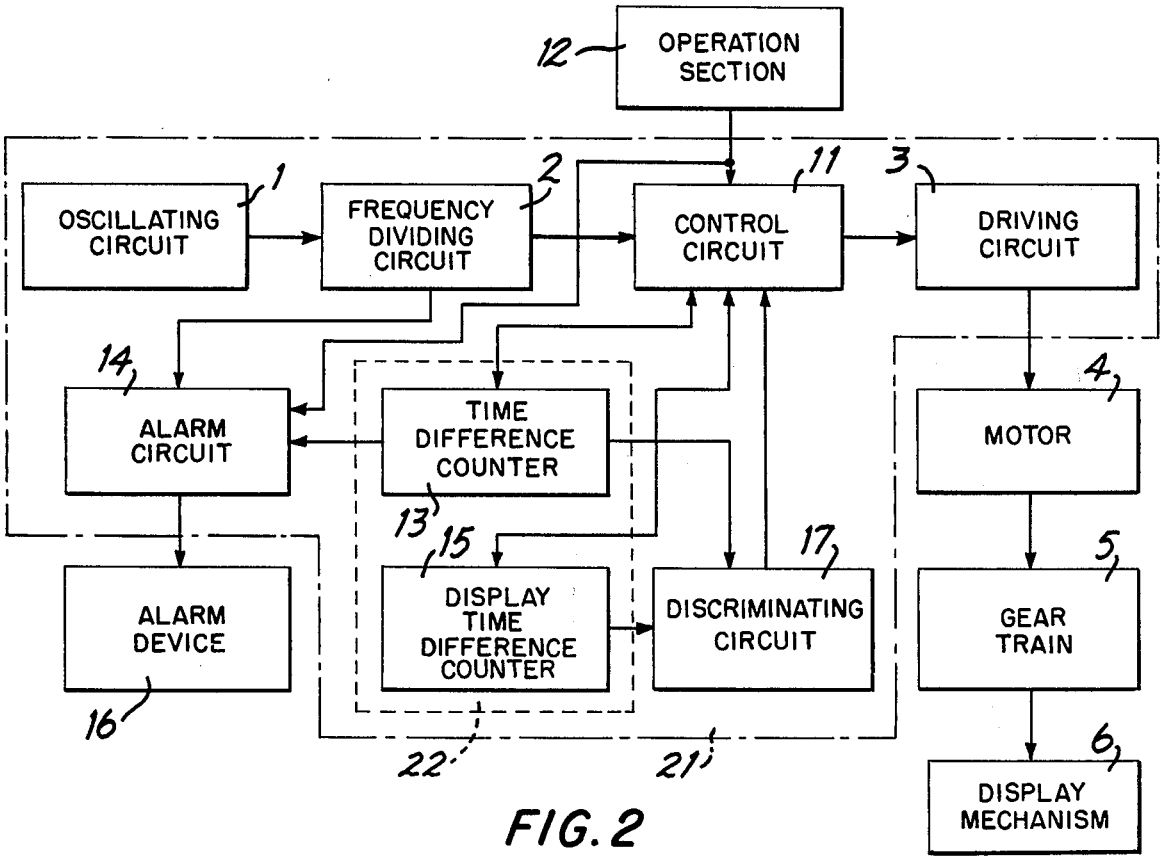
FIG. 2 is a block diagram of an embodiment of the present invention.
Figure 3:
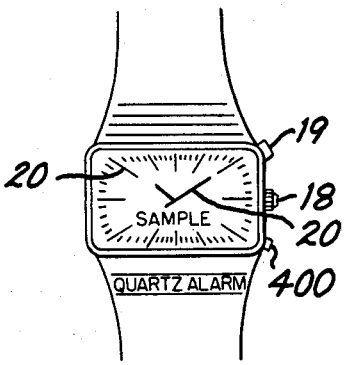
FIG. 3 is one example of a perspective view of analogue alarm electronic timepiece of the present invention.

FIG. 2 illustrates a block diagram of an embodiment of the present invention and FIG. 3 is a perspective view of the embodiment. Prior to the detailed explanation of the embodiment, the operation and manipulation of the embodiment of the present invention will be described generally.

An analogue alarm electronic watch embodying the present invention has two hands and these hands are moved every ten seconds. Since a counter in an electronic circuit is operated in synchronization with the position of the hands, a time correcting operation and an alarm time setting operation are not achieved by mechanical sliding operation, but these operations can be carried out by using the electronic circuit which is operated by an electric signal produced by the switch when a winding stem 18 is rotated.

When the present time correction is required, a button 19 should be positioned at a first pull-out position and the winding stem 18 should be positioned at a second pull-out position. The motor rotates in the forward direction or the reverse direction in accordance with the rotational direction of the winding stem 18, and hands 20 are moved in the forward or the reverse direction. As well as the present time correcting operation, displaying or setting the alarm time is carried out when the button 19 is pulled-out to a second pull-out position and the winding stem 18 is rotated in its first pull-out position. The hands 20 start to rotate at the same time when the button 19 is pulled-out, and the alarm time is indicated. At this time, the rotational direction of the hands is automatically decided on the basis of the necessary moved distance of the hands 20. Although the motor is reversible, for the mechanical limitations, the hands are moved at the rate of 128 steps/sec in the forward direction and the hands are moved at the rate of 32 steps/sec in the reverse direction. Therefore, in order to minimize the time required for moving the hand, the hands are rotated in the forward direction when the difference in time between the alarm time and the display time indicated by the hands is less than nine hours and thirty-six minutes, and is rotated in the reverse direction when the difference in time is more than that time.

In the foregoing explanation, since the standard of judgement on the rotational direction of the hands in the case that hand indication state is changed from the present time indicate state into the alarm time indication state is not the difference between the alarm time and the present time but the difference between the alarm time and the present-hand-indication time, the hand moving direction can be judged in accordance with the given purpose even if the hand indication time at the time when the hands start moving is not coincident with the present time, when the pull and push manipulations are repeated for a short time. For the same reason, in the case that the button 19 is positioned at the first pull-out position again, when the difference in time between the present hand indication time and the present time is less than two hours and twenty-four minutes, the indication mode in the timepiece becomes the present time indication state by rotating the hands in the reverse direction, and when the difference is more than two hours and twenty-four minutes, the indication mode becomes the present time indication state by rotation the hands in the forward direction.

Some embodiments of the present invention will be hereinafter described in more detail.

An oscillating circuit 1 functions as a signal source and generates a high frequency signal which is used as a time base signal, and the oscillating circuit 1 is controlled by a quartz vibrator. A frequency dividing circuit 2 divides down the high frequency signal and the frequency divided signal is applied to the subsequent circuits.

An operation section 12 produces electric signals when the winding stem, the button or the like designated by the numeral references 18, 19 or 400 in FIG. 3 are manipulated.

In a control circuit 11, whether a present time correcting state or an alarm time setting state is judged from the signal from the operation section 12, the time signal from the frequency dividing circuit 2 and the signals produced by operating the operation section 12 are processed to control the circuit described hereinafter. A time difference counter 13 is a 4320-counter for counting and storing the value corresponding to the difference in time between the alarm time and the present time. The value of 4320 is based on the following calculation;

$$12(\text{hour}) \times 60(\text{minutes}) \times 6[\text{steps/minute}]$$

The content of the counter 13 is decreased or increased by correcting the present time or setting the alarm time and is decreased by one every time of the application of time signal produced every 10 seconds.

A display-time difference counter 15 is a 4320-counter for calculating and storing the value corresponding to the difference in time between the display time and the present time, and the content of the counter is decreased or increased when the hands are moved. In the alarm time display state, the counter counts down by one every time of the application of the time signal produced every 10 seconds. A discriminating circuit 17 has the function for discriminating whether or not the difference time between the content of the time difference counter 13 and the content of the display-time difference counter 15 is more than 3456 (which corresponds to nine hours and thirty six minutes), function for discriminating whether or not the content of the display-time difference counter is more than 864 (which corresponds to two hours and twenty four minutes) and, the function for detecting whether or not the content of the time difference counter is coincident with the content of the display-time difference counter. An alarm circuit 14 synthesizes the output signals from the frequency dividing circuit 2 to produce various alarm driving signals, and outputs the alarm driving signal for a predetermined duration when the content of the time difference counter 13 becomes zero or when a signal from an input circuit (to be described hereinafter) is applied thereto. An alarm device 16 is an electric acoustic transducer which receives the alarm driving signal to produce an alarm sound.

A driving circuit 3 receives the output signals from the control circuit 11 to produce driving pulses for rotating a motor 4 in the forward or reverse direction. The mechanical output from the motor 4 is transmitted to the hands 6 via gear train 5 to display the time.

The oscillating circuit 1, the frequency dividing circuit 2, the control circuit 11, the driving circuit 3, the time difference counter 13, the display-time difference counter 15, the discriminating circuit 17 and the alarm circuit 14 which are enclosed with a dash line 21, are fabricated as a single electronic circuit.

The operation of the embodiment of the present invention will be described in conjunction with the detailed circuit arrangement. Since the oscillating circuit 1, the frequency dividing circuit 2, the alarm device 16, the gear train 5 and the hand 6 are well known, the detailed description of these elements are omitted.

Figure 4:
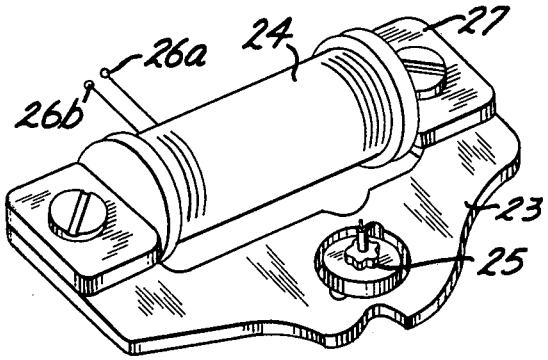
FIG. 4 is a perspective view of a motor used in the present embodiment.
Figure 5:
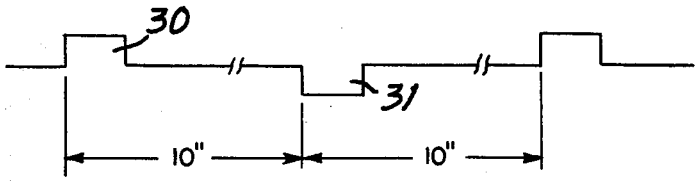
FIG. 5 is one example of a waveform of forward rotation driving signal for the motor.
Figure 6:
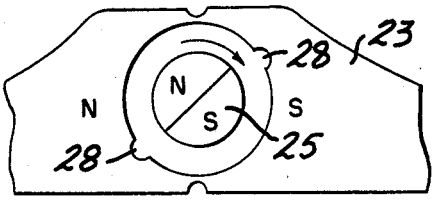
FIG. 6 is an illustrative view of the motor.

At first, one example of the reversible motor, which is an important element in the present invention, will be described. FIG. 4 illustrates a perspective view of a stepping motor which is used in the embodiment. The stepping motor has a coil 24, a magnetic core 27, a stator 23, a rotor 25 having two magnetic poles. In order to decide the stationary position of the rotor 25, as shown in FIG. 6, a pair of notches 28 is defined on the surface of the stator 23 and which face the rotor 25. Therefore, since the magnetic poles are produced in the stator 23 when the driving pulses illustrated by a reference 30 in FIG. 5 are applied between the coil terminals 26*a* and 26*b*, the rotor 25 is rotated for 180° in the direction shown by an arrow mark.

Since the reversed magnetic poles appear in the stator 23 when the driving pulses 31 with opposite polarity are applied to the coil, the rotor 25 is further rotated for 180° in the same direction as that indicated by the arrow mark. As a result, the rotational position of the rotor 25 becomes the original position shown in FIG. 6. After this, it is possible to continue the rotating operation of the rotor 25 if the alternating pulse signal is applied thereto.

Next, the driving operation of the motor in the reverse direction will be described.

Figure 7:
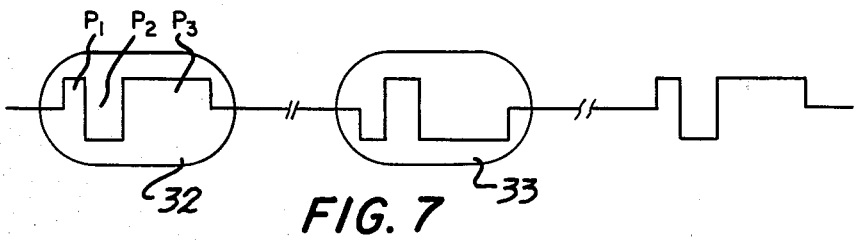
FIG. 7 is one example of a waveform of reverse rotation driving signal.
Figure 8A:
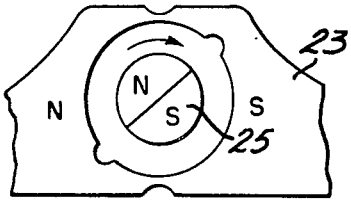
FIGS. 8A, 8B, 8C and 8D are illustrative views of the reverse rotating operation of the motor.
Figure 8B:
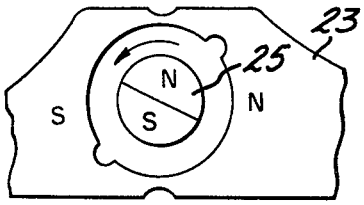
Figure 8C:
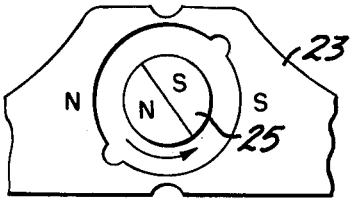
Figure 8D:
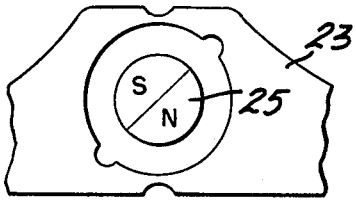

In FIG. 7, the waveform of a reverse direction driving pulse is illustrated. A series of pulses 32 involving pulses $P_1$, $P_2$ and $P_3$ is used for rotating the motor in the reverse direction by one step. The rotor 25 starts to rotate in the forward direction by the application of the pulse $P_1$, as shown in FIG. 8A. Then, when the pulse $P_2$ is applied to the motor, the rotor 25 is once stopped and then starts to rotate in the reverse direction as shown in FIG. 8B. The application of the pulse $P_3$ aids the rotor 25 to rotate in the reverse direction. Finally, the rotor 25 is positioned in stable condition at the position shown rotated in the reverse direction for 180° from the position shown in FIG. 8A, and positioned in stable condition at the position shown in FIG 8D. The rotor 25 is rotated in the reverse direction by the application of a reverse driving pulse train 33 which has an opposite polarity to the pulse train 32.

The operation of the driving circuit 3 will be described in conjunction with FIG. 9, FIG. 10A and FIG. 10B. A clock input terminal C of a D type flip-flip 50 is connected to an input terminal 48 and input terminals of an AND gates 51 and 52. Output terminals Q and $\overline{Q}$ thereof are connected to input terminals of the AND gates 51 and 52, respectively, and a data input terminal D is connected to the terminal Q. The output terminals of the AND gates 51 and 52 are connected to input terminals of Ex-OR gates 53 and 54, respectively. The other input terminals of the Ex-OR gates 53 and 54 are commonly connected to a terminal 49, and output terminals thereof are respectively connected to the input terminals of inverters 55 and 56. Output terminals of the inverters 55 and 56 are respectively connected to a coil 24 of the motor via terminals 26*a* and 26*b*.

Figure 10A:
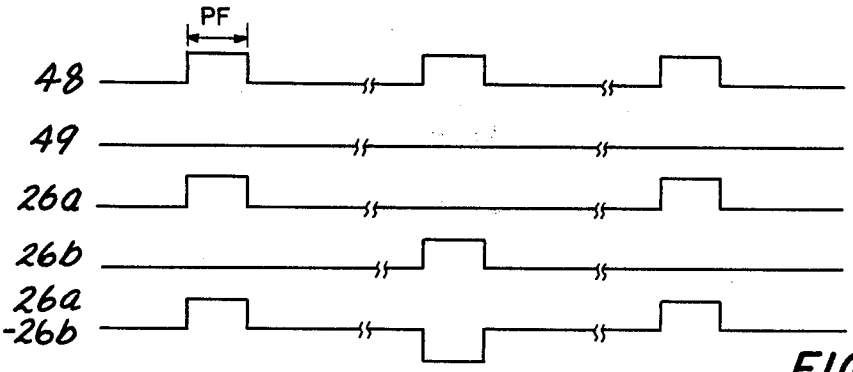
FIGS. 10A and 10B are timing charts for illustrating the operation of the driving circuit.

FIG. 10 illustrates a timing chart at the time of the driving operation for forward rotation. The output level of the D type flip-flop 50 is changed every time when one pulse is applied to the input terminal thereof, when the signal shown in FIG. 10A is applied to the terminals 48 and 49. As a result, the pulses with pulse width of $P_F$ shown by 26*a* and 26*b* of FIG. 10A are alternately obtained fom output terminals 26*a* and 26*b* of the inverter 55 and 56. The voltage applied to the coil 24 is equal to the potential difference between both end terminals of the coil, that is, the voltage difference between the voltage value of the outputs 26*a* and 26*b*. Consequently, the stepping motor is rotated in the forward direction in turn.

Figure 10B:
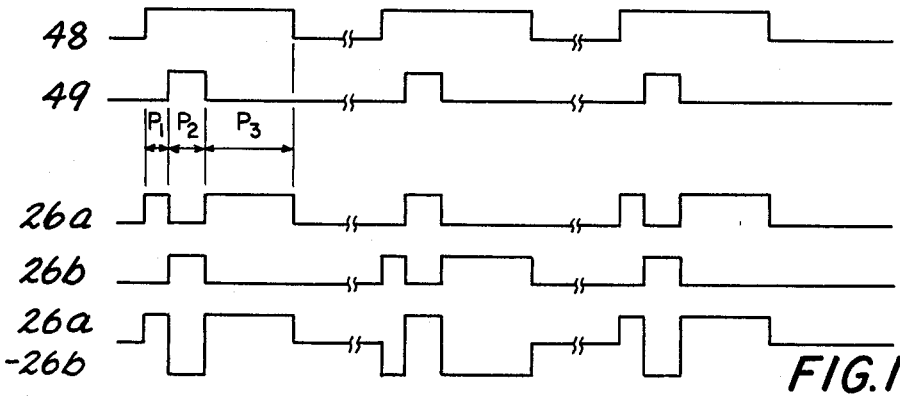

FIG. 10B illustrates a timing chart at the time of the reverse rotating operation of the stepping motor.

As well as the forward rotating operation, the output level of the d type flip-flop 50 is changed every time when one pulse is applied to the terminal 48. However, since the output from Ex-OR gates 53 and 54 is inverted at the time of the rising edge of the pulses applied to the terminal 49, the driving pulse train whose waveform is shown by the reference (26*a*-26*b*) of FIG. 10B, is applied to coil 24. Therefore, as described above, the motor is rotated in the reverse direction in turn.

Figure 11:
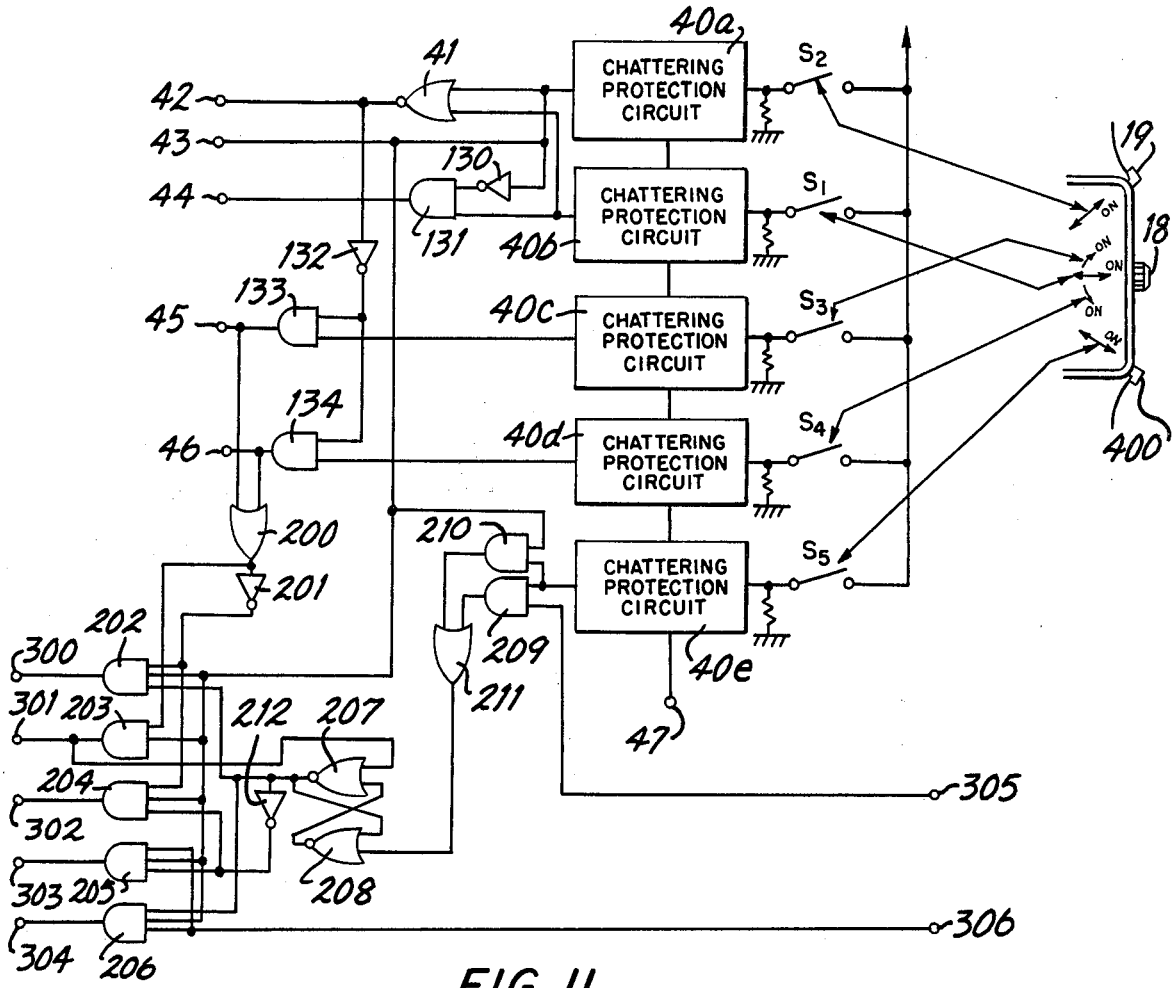
FIG. 11 is one example of an input circuit for processing the signal from an operation section.

FIG. 11 illustrates an input circuit which supplies the signal from the operation section 12 to the control circuit 11 and the alarm circuit 14. A switch $S_1$ is turned on when the winding stem 18 is pulled-out. A switch $S_3$ is turned on when the winding stem 18 is rotated in the opposite direction, and a switch $S_4$ is turned on when the winding stem 18 is rotated in the front direction. A switch $S_2$ is turned on when the button 19 is pulled-out. A switch $S_5$ is turned on when the button 400 is pulled-out.

The switch $S_5$ is used for selecting an alarm set state or an alarm reset state when the present time is coincident with an alarm time in the present time display mode of the hands. The alarm set state is the state in which an alarm sound can be made, and the alarm reset state is the state in which the alarm sound can be not made.

Input signal waveforms from the switches are respectively applied to chattering protection circuits 40*a*, 40*b*, 40*c*, 40*d* and 40*e* to shape these input signal waveforms, and the wave-shaped signals are produced therefrom in synchronization with a signal of 128 Hz applied to a clock input terminal 47. The output from the chattering protection circuit 40*a* is applied to a NOR gate 41, an inverter 130, AND gates 202, 203, 204, 205, 206 and 210 and a terminal 43. The output from the chattering protection circuit 40*b* is applied to the NOR gate 41 and an AND gate 131. The output from the inverter 130 is applied to the AND gate 131, and the output from the NOR gate 41 is applied to the terminal 42 and an inverter 132. The output from the AND gate 131 is applied to a terminal 44, and the output from the inverter 132 is applied to AND gates 133 and 134. The outputs from the chattering protection circuits 40*c* and 40*d* are applied to the input terminals of the AND gates 133 and 134, respectively. The outputs from the AND gates 133 and 134 are applied to an OR gate 200, the terminal 44 and a terminal 45, respectively. The output from an OR gate 200 is applied to the AND gate 203 and an inverter 201, and the output from the inverter 201 is applied to the AND gates 202 and 204. The output from the chattering protection circuit 40*e* is applied to the AND gate 210 and an AND gate 209, and the outputs from the AND gates 209 and 210 are applied to an OR gate 211. The terminal 305 is connected to the AND gate 209. The output from the OR gate 211 is applied to a NOR gate 208 which acts as a R-S flip-flop by combining with a NOR gate 207. The output from the AND gate 203 is applied to a terminal 301 and the NOR gate 207. The output from the NOR gate 207 is applied to an inverter 212, the AND gate 202 and the AND gate 206. The output from the inverter 212 is applied to the AND gates 204 and 205. The terminal 306 is connected to the AND gates 205 and 206. The output from the AND gate 202 is applied to a terminal 300, and the output from the AND gate 204 is applied to a terminal 302. The output from the AND gate 205 is applied to a terminal 303, and the output from the AND gate 206 is applied to a terminal 304. The signals appearing on the terminals 42, 43 and 44 shows the operation states in the operation section. The relationships among the each of states of the switches and level conditions in the terminals, are shown in Table 1.

TABLE 1

| | $S_1$ OFF | | $S_1$ ON | |
|---|---|---|---|---|
| Terminal | $S_2$ OFF | $S_2$ ON | $S_2$ OFF | $S_2$ ON |
| 42 | H | L | L | L |
| 43 | L | H | L | L |
| 44 | L | L | H | L |

The level of the terminal 42 becomes high in the condition of the present time display state, the level of the terminal 43 becomes high in the condition of the alarm time display/set state, and the level of the terminal 44 becomes high in the condition of the present time correction state. These high level states appear relatively and exclusively.

In the case of the alarm time display-set state, the level of the terminal 300 becomes high when the hands are moving to indicate the alarm time or when the alarm time is indicated by the hands in the alarm reset state. In the alarm time display-set state, the level of terminal 301 becomes high when the alarm time setting operation is carried out by rotating the winding stem 18. The R-S flip-flop consisting of the NOR gates 207 or 208 is reset by the application of signal from the terminal 301 and the alarm set state is established. In the alarm time display-set state, the level of the terminal 302, becomes high when the hands are moving to the position corresponding to the alarm time or when the alarm time is indicated in the alarm set state. In the alarm time display-set state, the level of the terminal 303 becomes high when the alarm time is indicated by the hands in the alarm set state. In the alarm time display-set state, the level of the terminal 304 becomes high when the alarm time is indicated in the alarm reset state. The R-S flip-flop consisting of the NOR gates 207 and 208 stores the selected condition of the alarm set state or the alarm reset state. In the alarm time display-set state (ON condition of the switch $S_2$), the output level of the OR gate 211 becomes high when the switch $S_5$ is turned on. Therefore, the output level of the NOR gate 207 becomes high to establish the alarm reset state. The terminal 305 is connected to a terminal 64. The level of the terminal 64 becomes high when the present time is coincident with the alarm time. If the switch $S_5$ is turned on in the high level of the terminal 305, the output level of the NOR gate 207 becomes high to establish the alarm reset state. On the other hand, if the switch $S_5$ is turned off in the high level condition of the terminal 305, the state of the R-S flip-flop consisting of the NOR gates 207 and 208 is not changed and the alarm operation is intermittently carried out. The terminal 306 is connected to a terminal 66. The level of the terminal 66 is high when the hand indicates an alarm time. The signals from the terminals 42, 44, 300, 301, 302, 303 and 304 of the input circuit are applied to the alarm circuit 14 and various sound signals according to the hands display state, such as no sound in the present time display state, three long-time sounds every one second in a present time correcting state, one long-time sound every one second when the hands are moving to indicate the alarm time in the alarm time display-set state or when the alarm time is indicated in the alarm reset state, two short-time sounds every one second when the alarm time setting operation is carrying out by the rotation of the winding stem 18 in the alarm time display-set state, one short-time sound every one second when the hands are moving to indicate the alarm time in the alarm time display set state or when the alarm time is displayed in the alarm set state, two long-time sounds every one second when the alarm time is indicated in the alarm time display-set state and the alarm set state, one short-time sound and one long-time sound every one second when the alarm time is indicated in the alarm reset, so that the display state by the hands can be recognized. The short-time sounds are continuously produced for twenty seconds when the present time is coincident with the alarm time in the present time display state and the alarm set state.

Figure 12:
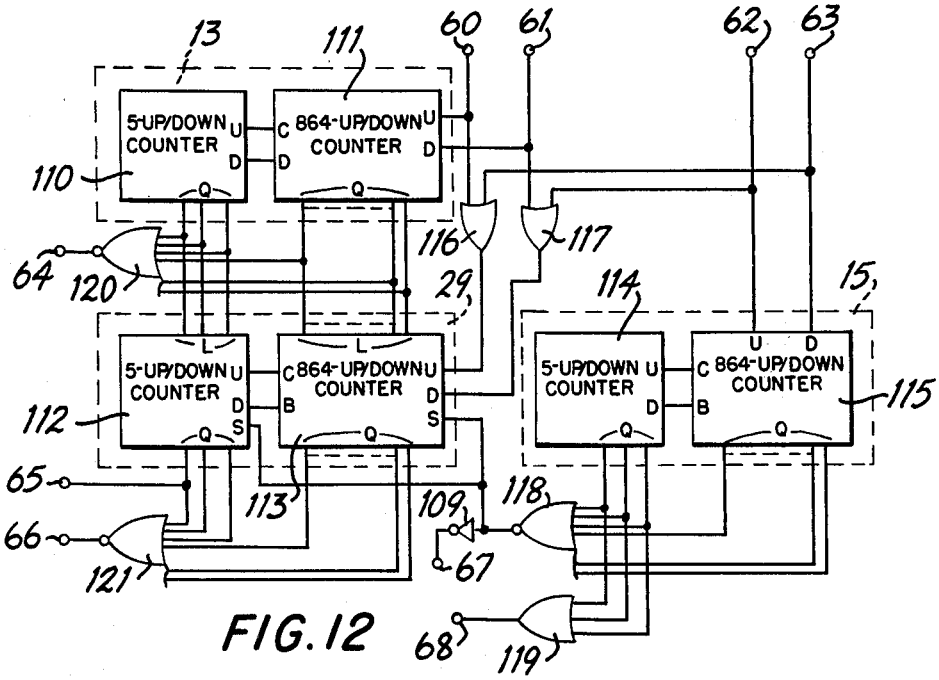
FIG. 12 is a circuit diagram illustrating one example of a memory circuit and a discriminating circuit.

A more detailed description of the time difference counter 13, the display-time difference counter 15 and the discriminating circuit 17 will be described in conjunction with FIG. 12.

The time difference counter 13, the display-time difference counter 15 and a counter 29 involved in the discriminating circuit 17, are 4320-counters. Each of the 4320-counters consists of 864-up/down counters 111, 113 and 115, and 5-up/down counter 110, 112 and 114, respectively, as shown in FIG. 12. The carry signal terminals C of the 864-counters are connected to the up-terminals U of the 5-counters corresponding thereto, and the borrow signal terminals B of the 864-counters are connected to the down-terminals D of the 5-counters corresponding thereto, respectively. By such an arrangement, the 864-counter and corresponding 5-counter operates as 4320-counter. In addition, the counter 29 is presettable. A terminal 60 is connected to the up-input terminal U of the time difference counter 13 and an input terminal of an OR gate 116, and a terminal 61 is connected to the down-input terminal D of the time difference counter 13 and an input terminal of an OR gate 117. A terminal 62 is connected to the up-input terminal of the display-time difference counter 15 and the other input terminal of the OR gate 117, and a terminal 63 is connected to the down-input terminal D of the display-time difference 15 and the other input terminal of the OR gate 116. The output terminals of the OR gates 116 and 117 are the up-input terminal U and the down-input terminal D of the counter 29, respectively. All of the binary-coded output terminals Q of the time difference counter 13 are connected to the input terminals of a NOR gate 120 and corresponding preset data terminals L of the counter 29, and the output of the NOR gate 120 is connected to a terminal 64.

All of the binary-coded output terminals Q of the display-time difference counter 15 are connected to the input terminals of a NOR gate 118, and the binary-coded output terminals of the 5-counter 114 are connected to the input terminals of an OR gate 119. The output terminal of the NOR gate 118 is connected to the present clock terminals S of the counter 29 and is connected to a terminal 67 via an inverter. The output terminal of the OR gate 119 is connected to a terminal 68.

All of the binary-coded output terminals of the counter 29 are respectively connected to the input terminals of a NOR gate 121, and the output terminal of the NOR gate 121 is connected to a terminal 66. The most significant digit of the binary-coded output from the 5-counter 112 is supplied to a terminal 65.

The operation of the circuit will be now described. The time difference counter 13 carries out count up or down operation in accordance with the state of the pulse from the terminals 60 and 61, and a zero detecting signal is produced from the terminal 64 when the content of the counter 13 becomes zero. The zero detecting signal is applied to the alarm circuit as a coincidence detecting signal which shows the fact that the present time is coincident with the alarm time. The display-time difference counter 15 carries out the count up or down operation in response to the state of the pulses applied to the terminals 62 and 63. When the content of the counter 15 becomes zero, a zero detecting signal appears on the terminal 67, and when the content of that becomes more than 863, a magnitude detecting signal appears on the terminal 68. The content of the time difference counter 13 is transferred into the counter 29 when the content of the display-time difference counter 15 is zero. Then, the counters 112, 113 are operated as an up-counter by the application of the time difference counter-up signal from the terminal 60 and the display-time difference counter-down signal. The counters are also operated as a down counter by the application of the down signal for the time difference counter 13 from the terminal 61 and the up signal for the display-time difference counter 15 from the terminal 62.

As a result, the content of the counter 29 corresponds to the difference value between the contents of the time difference counter 13 and the display-time difference counter 15, that is, between the alarm time and the present time. When the content of the counter 29 becomes zero, that is, the alarm time is coincident with the present time, a coincidence detecting signal is produced from the terminal 66. The magnitude detecting signal is produced from the terminal 65 when the content of the counter 29 is more than 3456.

Now, the arrangement and the function of the control circuit 11 will be described.

Figure 13:
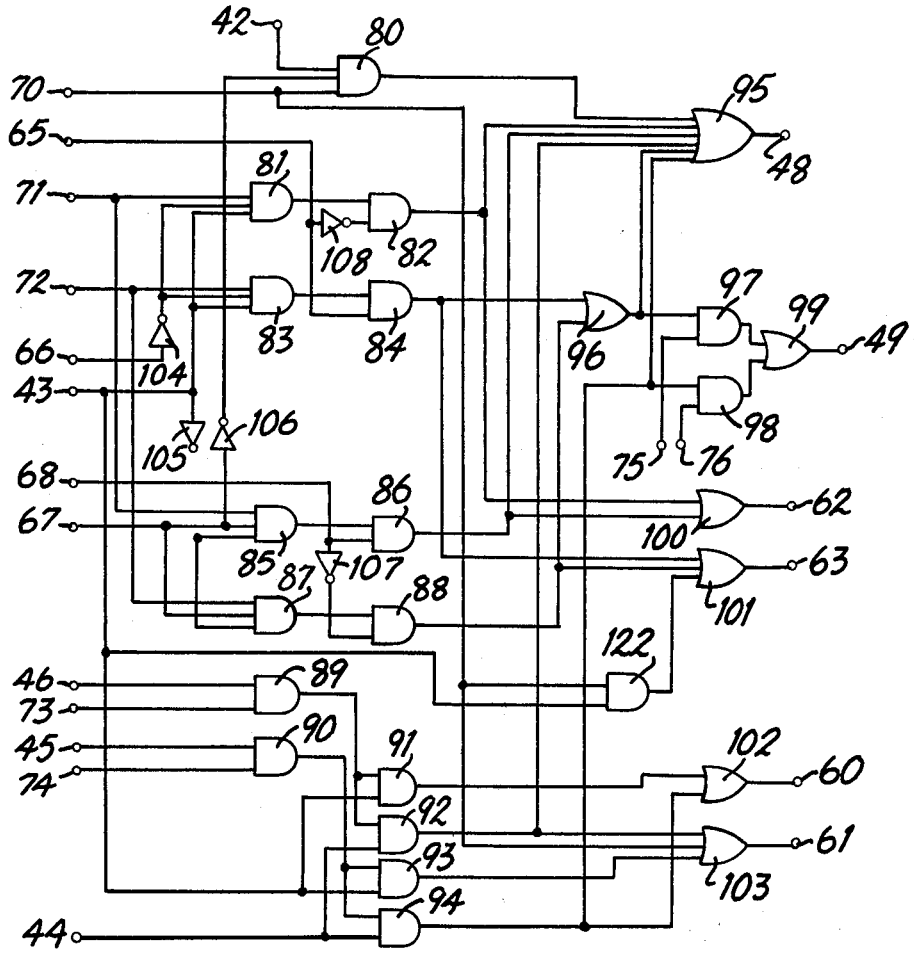
FIG. 13 is a circuit diagram of one example of a control circuit.

The terminals 42, 43, 44, 45 and 46 shown in FIG. 13 are connected to the corresponding output terminals of the input circuit shown in FIG. 11, respectively.

Figure 9:
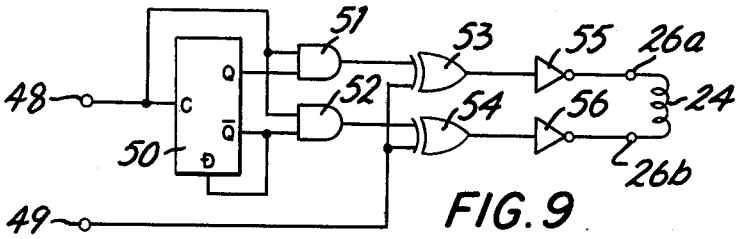
FIG. 9 is a circuit diagram of one example of a driving circuit.

The terminals 48 and 49 are connected to the input terminals of the driving circuit shown in FIG. 9, respectively.

Figure 14:
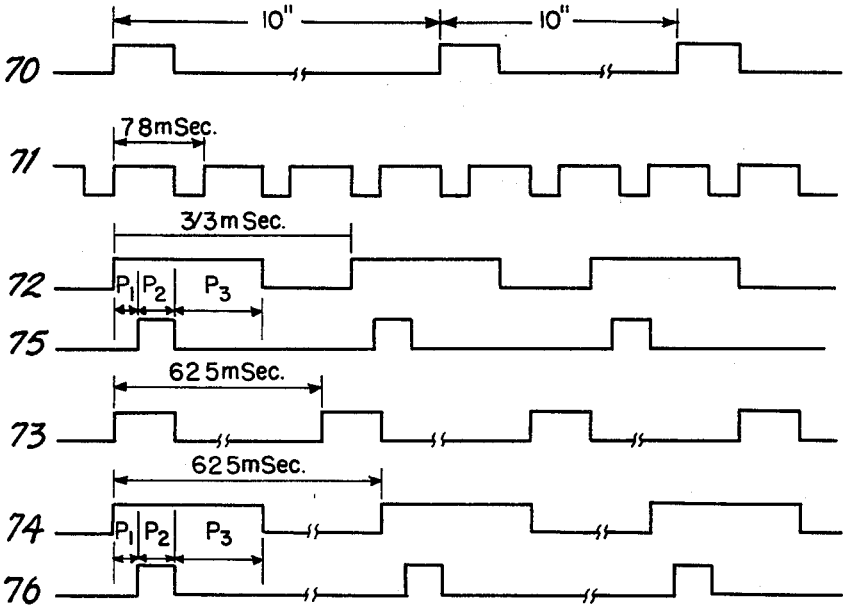
FIG. 14 is a pulse waveform applied to the control circuit.

The terminals 70 through 76 are connected to the output terminals of the waveform synthesizing circuit (not shown) which produce signals with any waveforms by synthesizing output signals from the frequency dividing circuit. The signals whose waveforms are shown by the references 71 to 76 of FIG. 14 are continuously applied to these input terminals without the time from a timing pulse for moving the hands every 10 seconds, which is shown by the reference 70 of FIG. 14, to the time of 31.3[msec].

The terminals 62, 63, 60, 61, 65, 66, 67 and 68 are connected to the memory 22 and the discriminating circuit 17.

In the normal operation, the level of the terminal 42 is high, and the levels of the terminals 43 to 46 are low. Therefore, when the level of the terminal 67 is low, that is, the display-time indicated by the hands is coincidence with the present time, the timing pulse for moving the hands every ten seconds, which is applied to the terminal 70, is supplied to the driving circuit. As a result, the motor is rotated in the forward direction every ten seconds, and the down-input signal for the time difference counter 13 is produced from the terminal 61. When the level of the terminal 67 is high, that is, the display-time indicated by the hands is not coincident with the present time (when the hands are moving from the display position for indicating the alarm time to the display position for indicating the present time), the normal ten seconds movement of the hands is stopped. In this case, when the level of the terminal 68 is high (when the content of the display-time difference counter 15 is more than 868), the pulses for moving the time hand in the forward direction are supplied to the driving circuit, and the up signal for the display-time difference counter is produced from the terminal 62. The pulses for moving the hands are in the forward direction is the pulses of 128/sec and supplied from the terminal 71. When the level of the terminal 68 is low, that is the content of the display-time difference counter is less than 864, the pulses for moving the hands in the reverse direction, which are pulses of 32/sec and supplied from the terminals 72 and 75, are applied to the driving circuit 3. At the same time, the down signal for the display-time difference counter 15 is output from the terminal 63. The moving operation of the hands is continued until the content of the display-time difference counter 15 becomes zero. Even if the hands are moving, the down signal for the time difference counter 13 is produced from the terminal 61 every ten seconds.

In the present time correction state, the level of the terminal 44 is high and the levels of the terminals 42 and 43 are low. At this time, pulses are applied to the terminals 45 and 46 by rotating the winding stem.

In this condition, normal ten second moving for the hands is stopped, and the level of the terminal 46 becomes high when the winding stem 18 is rotated in the forward direction. Therefore, the forward rotating correction pulse of 16 pulses/sec supplied from the terminal 73 is applied to the driving circuit 3, and the down signal for the time difference counter 15 is produced from the terminal 61. When the winding stem 18 is rotated in the opposite direction, the level of the terminal 46 becomes high, and the reverse rotating correction pulse supplied from the terminals 74 and 76 is applied to the driving circuit 3. At the same time, the up signal for the time difference counter 13 is produced from the terminal 60. Therefore, the present time is corrected, and the relative time difference between the alarm time and the present time is maintained at the exact value by using the time difference counter 13 as an up counter or a down counter.

In the alarm time display/set state, the level of the terminal 43 is high and the levels of the terminals 42 and 44 are low. Therefore, pulses are applied to the terminals 45 and 46 by rotating the winding stem 18. In this condition, at first, the time hands are moved. Since the level of the terminal 64 is changed to low level by the discriminating circuit 17 when the difference between the alarm time and the present time is less than 3456, the forward rotating pulses for moving the hands, which are pulses of 128 pulses/sec and supplied from the terminal 71, are applied to the driving circuit 3, and the up signal for the display-time difference counter 15 is obtained from the terminal 62. When the difference between the alarm time and the present time is more than 3456, the level of the terminal 65 becomes high. Then, the pulses for moving the hands in the reverse direction, which are pulses of 32 pulses/sec and are supplied from the terminal 72 and 75, are applied to the driving circuit 3, and the down signal for the display-time difference counter 15 is produced from the terminal 63. Moving the time hands is continued until the alarm time is coincident with the present time and the level of the terminal 66 becomes low.

After this operation, it is possible to correct the alarm time by rotating the winding stem 18. Since the level of the terminal 46 becomes high when the winding stem 18 is rotated in the forward direction, the forward rotating time correction pulses are obtained from the terminal 60 as the up signal for the time difference counter. As a result, the content of the time difference counter 13 becomes larger than that of the display-time difference counter 15 by one. Therefore, the time hands are moved in the forward direction, and the hand is advanced by one step. When the winding stem 18 is rotated in the opposite direction, the level of the terminal 45 becomes high so that the reverse rotating correction driving pulses supplied from the terminal 74 are obtained from the terminal 61 as the down signal for the time difference counter 13. As a result, the time hand is moved in the reverse direction by one step.

Under the alarm time display/set state, pulses for moving the time hand every ten seconds are not produced. However, the down signal for the time difference counter 13 and the down signal for the display-time difference counter 15 are produced from the terminals 61 and 63 every ten seconds.

Since the watch has the above mentioned functions, it is possible to store the relative relationship among the alarm time, the present time and the display time. Consequently, as described above, when the present time display state is selected, the time hand is moved until the content of the display-time difference counter 15 becomes zero, and the present time can be exactly displayed.

Now, another embodiment of the present invention will be described.

Figure 15:
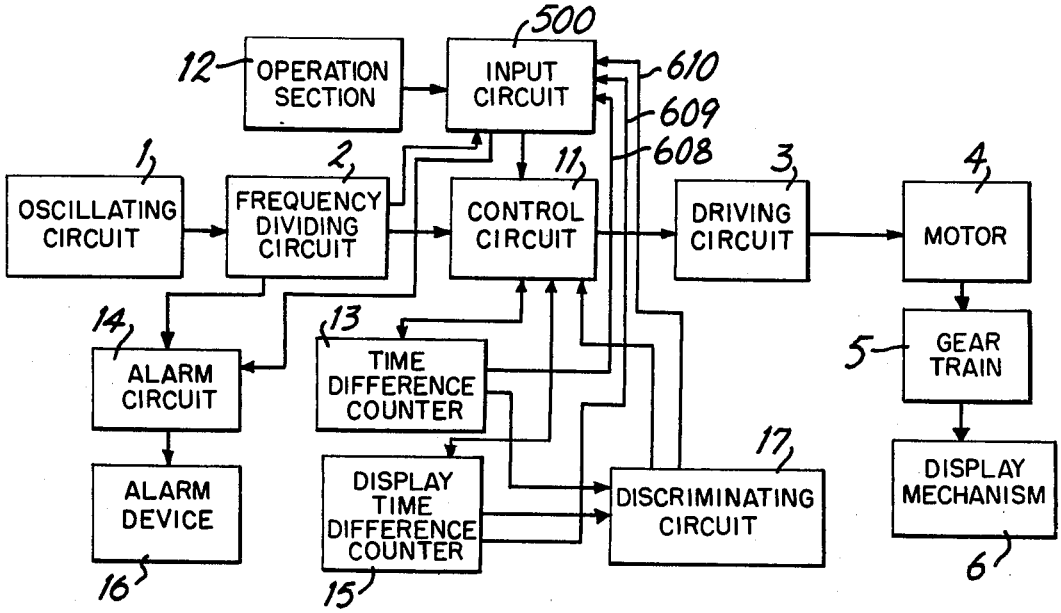
FIG. 15 is a block diagram illustrating another circuit arrangement of an analogue alarm electronic timepiece of the present invention.
Figure 16:
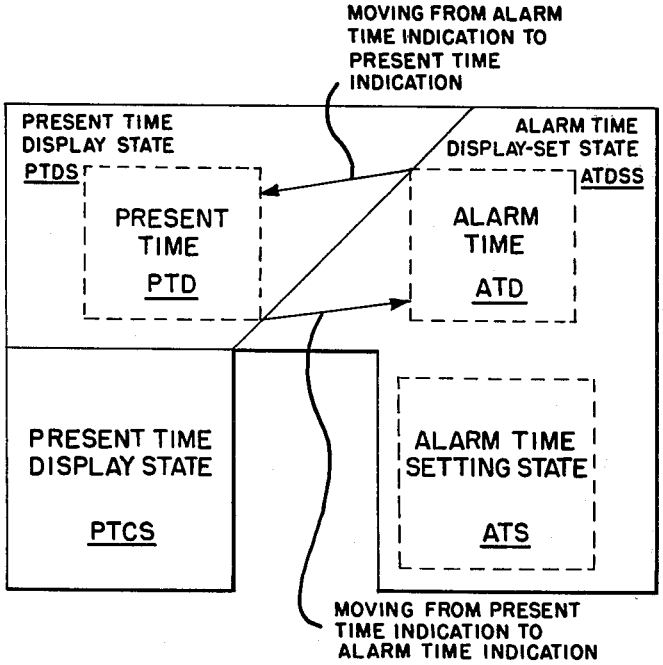
FIG. 16 is one example of a hand indication state chart.

In other to inform an operator of the hand indication state when the hand indication state is changed as shown in FIG. 16, the embodiment of FIG. 15 has an input circuit 500 which is arranged so as to produce various sounds.

That is, (1) One short-time sound every one second is produced in the alarm time display-set state (ATDSS) and in the alarm reset state;

(2) One long-time sound every one second is produced in the alarm time display-set state (ATDSS) and in the alarm set state;

(3) Two short-time sounds are producted at the time when the hands indicate the alarm time (ATD) in the alarm time display-set state (ATDSS);

(4) Short-time sounds are produced for twenty seconds when the hand indication time becomes the present time in the alarm time display-set state (ATDSS), when the hand indication time becomes the alarm time in the present time correcting state (PTCS) or when the hand indication time becomes the alarm time in the present time display state (PTDSS) and in the alarm set;

(5) Two long-time sounds are produced at the time when the hand indication state is changed from the present time display state (PTDS) into the alarm time display-set state (ATDSS);

(6) Three short-time sounds are produced at the time when the hand indication state is changed from the alarm time display-set state (ATDSS) into the present time display state (PTDS), and;

(7) Three long-time sounds are produced at the time when the hand indication state is changed from the alarm time display-set state (ATDSS) into the present time display time and the hand indicates the present time. The respective states are shown in FIG. 16.

Figure 17:
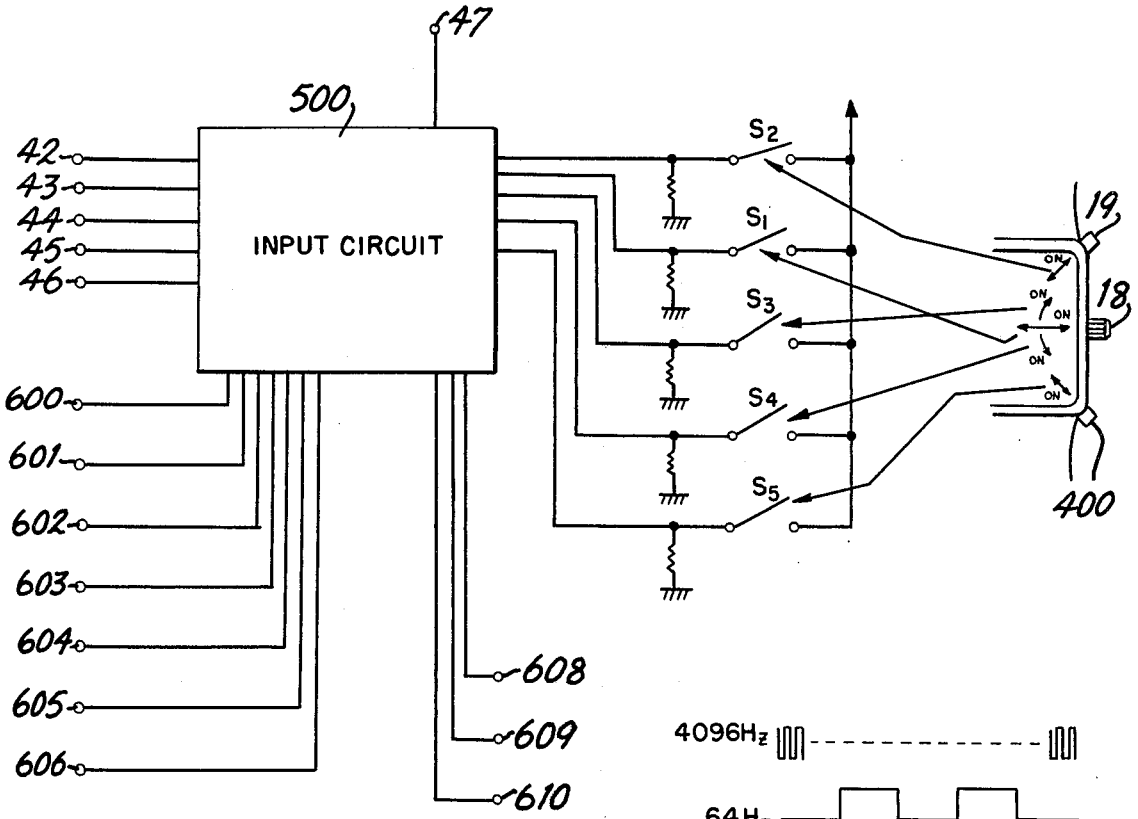
FIG. 17 is one example of a circuit diagram of an input circuit.

FIG. 17 illustrates the input circuit 500. The input circuit 500 produces signals used for generating the various sounds described in the aforesaid items (1) to (7) from terminals 600 to 606 and signals applied to the control circuit 11 on the basis of the signals from the switches $S_1$ to $S_5$ which are output signals from the operation section 12, a signal from a terminal 608 to which the output of the time difference counter 13 is connected, a signal from a terminal 609 to which the output of the display-time difference counter 15 is connected, and a signal from a terminal 610 to which the output of the discriminating circuit 17 is connected. The terminals 600 to 606 are connected to the alarm circuit 14, and the alarm circuit 14 synthesizes various sounds on the basis of the signals from the terminals 600 through 606 to supply an alarm driving signal to the alarm device 16.

Figure 18B:
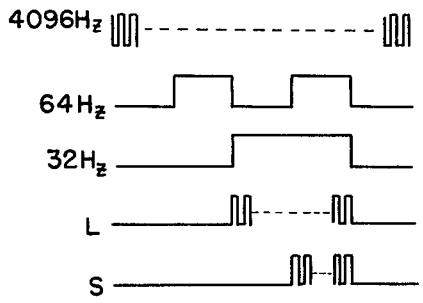
FIG. 18B is a waveform in the alarm circuit.
Figure 18A:
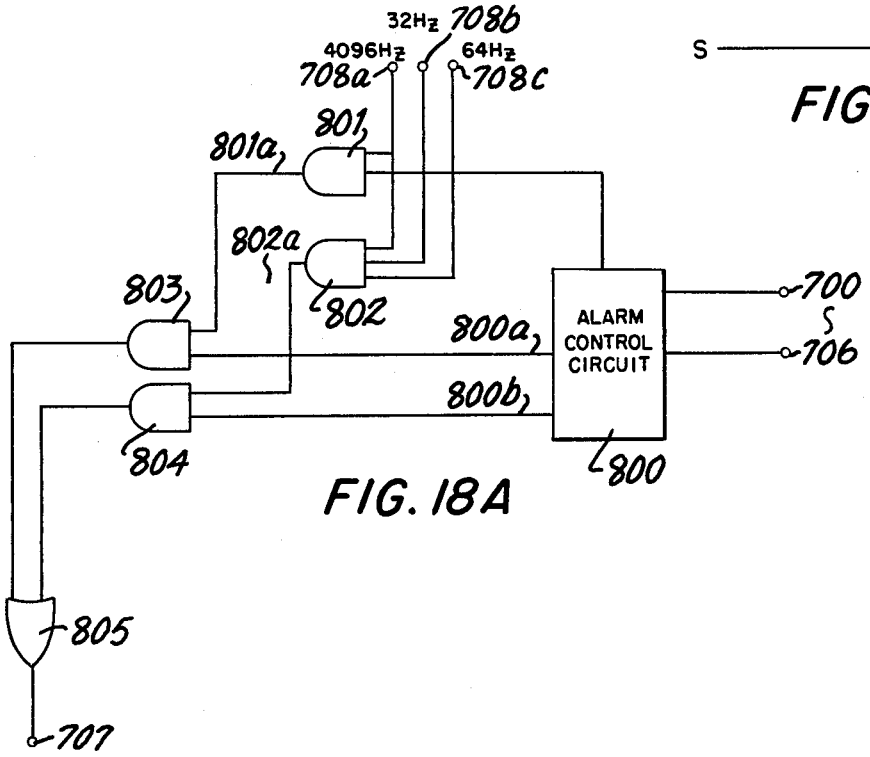
FIG. 18A is one example of a circuit diagram of an alarm circuit.

FIG. 18A illustrate a circuit diagram of one embodiment of the alarm circuit 14. Signals of 4096[Hz], 32[HZ] and 64[Hz] from the frequency dividing circuit 2 are applied to terminals 708*a*, 708*b* and 708*c*, respectively. Terminals 700 to 706 are respectively connected to the terminals 600 to 606 of the input circuit 500. An alarm control circuit 800 outputs signals for generating the long-time sound or the short-time sound to the terminals 800*a* and 800*b* in synchronization with the signal of 32[Hz] on the basis of signals from the terminals 700 to 706. An AND gate 801 is a short-time-sound generating circuit. In FIG. 18B, a waveform of output signal 802*a* of an AND gate 802 is shown by the reference S. The output signal 801*a* of the AND gate 801 is applied to an AND gate 803. The output signal 801*a* is controlled by the output 800*a* from the alarm control circuit 800. The output 802*a* of the AND gate 802 is connected to AND gate 804 and it is controlled by the output from the alarm control circuit 800. Between the output from the AND gate 803 and the output from an AND gate 804, the OR operation is carried out in an OR gate 805. The output from the OR gate 805 is applied to the alarm device 16 through the terminal 707 to produce a sound. As the other parts of the embodiment are the same as that of the foregoing embodiment, the discription thereon will be omitted.

The principles of the invention exists in that the present time and the alarm time can be displayed by using a single display mechanism if the relative time differences among the present time, the alarm time and the display time are known. Although there are three relative time differences, if any two relative time differences are known, the remaining one can be calculated on the basis of the two relative time differences. Therefore, the relative time differences to be stored is not limited to the two set of the difference in time, between the alarm time and the present time and between the display time and the present time. In this embodiment, in order that the present invention is easily understood, an analogue alarm electronic timepiece which specification is the most simple is employed. For example, in this specification, although the time difference counter 13 and the display-time difference counter 15 are 4320-counter, the same effect as that in the use of 4320-counter even if 8640-counters are used for the counters 15 and 13. It is easy to apply the present invention to the timepiece having more complex functions and specification. In this embodiment, the arrangement is adapted so as to produce different sounds in accordance with the hand indicating state or the set condition of the alarm function, however, it is easily carried out to produce the same kind of sounds or no sound under certain circumstances.

In this invention, it is essential matter that the time correcting operation is not carried out by the sliding mechanism, but by an electronic circuit. It is the reason why the relative time difference among the display time, the present time and the alarm time differs from the content stored in the electronic circuit when the hand moving operation is carried out by some mechanical sliding mechanism. To solve the above described drawbacks, although some mechanism which inputs the display time indicated by the hands into the electronic circuit, in this case, the merit of the invention, which is simple in construction, is extremely reduced.

In the above described embodiments, although all of the electronic circuits are realized by the use of the fixed logic circuit, in order to carry out the more complex operation, the electronic circuits can be realized by the use of the logic operation processing circuit employing the stored program system. In this case, although the description in this claim is not always proper to such a stored program system, it should be noted that the timepiece employing the logic operation processing circuit is within the scope of the present invention.

According to the present invention, since it is possible to recognize what the display state is, whether or not the alarm sound can be produced or whether or not the timepiece is alarm stop mode, by producing various sounds, the wrong operation of the timepiece can be reduced and it is possible to provide an analogue alarm electronic timepiece which is simple in mechanism.

What is claimed:

1. In an analogue alarm electronic timepiece: a reversible rotary motor; a set of time hands connected to be driven by the motor for indicating a present time and an alarm time; an alarm device operable when enabled for producing an alarm sound at a preset alarm time; an electronic circuit comprising means for developing drive pulses representative of time, a driving circuit for applying the drive pulses to the motor to rotate the motor in the forward or reverse direction, first settable memory means for storing a time difference between a first two of the alarm time, the present time and a display time, second settable memory means for storing a time difference between a second two different than the first two of the alarm time, the present time and the display time, first means for detecting the coincidence between the first two times, and second means for detecting the coincidence between the second two times; and operating means including a set of externally operable switches coacting with the electronic circuit for controlling the drive of the time hands by the motor to selectively position the time hands at desired alarm time and display time settings accompanied by setting of the first and second memory means in accordance with the selected position of the time hands and to selectively re-position the time hands at the previously set alarm time to enable the user of the timepiece to confirm the preset alarm time and for enabling the alarm device.

2. An analogue alarm electronic timepiece as claimed in claim 1; wherein the first memory means comprises an up-down counter for counting the difference between the alarm time and the present time, and the second memory means comprises an up-down counter for counting the difference between the display time and the present time.

3. An analogue alarm electronic timepiece as claimed in claim 1; wherein the first two times comprise the alarm time and the present time, and the second two times comprise the present time and the display time.

* * * * *